US006598706B1

(12) United States Patent
Takeuchi

(10) Patent No.: US 6,598,706 B1
(45) Date of Patent: Jul. 29, 2003

(54) EMERGENCY ESCAPE VERANDA APPARATUS

(75) Inventor: Mitsuo Takeuchi, Iwaki (JP)

(73) Assignee: Takeuchi Precision Works Co., Ltd., Iwaki (JP)

( * ) Notice: Subject to any disclaimer, the term of this patent is extended or adjusted under 35 U.S.C. 154(b) by 0 days.

(21) Appl. No.: 09/696,915

(22) Filed: Oct. 27, 2000

(30) Foreign Application Priority Data

Oct. 28, 1999 (JP) ..... 11-306383

(51) Int. Cl.[7] ..... B66B 9/00; E06C 9/10

(52) U.S. Cl. ..... 187/239; 182/141; 182/82

(58) Field of Search ..... 187/239, 250, 187/270, 255, 256, 351, 352, 900; 182/141, 82, 85

(56) References Cited

U.S. PATENT DOCUMENTS

| | | | | | |
|---|---|---|---|---|---|
| 98,203 | A | * | 12/1869 | Stein et al. | 187/239 |
| 394,781 | A | * | 12/1888 | Maurer | 187/239 X |
| 464,900 | A | * | 12/1891 | Schwannecke | 187/434 X |
| 473,572 | A | * | 4/1892 | Gunnarson | 187/343 X |
| 553,299 | A | * | 1/1896 | Campbell | 187/352 X |
| 612,599 | A | * | 10/1898 | Ward | 187/343 |
| 663,680 | A | * | 12/1900 | May et al. | 187/343 X |
| 673,301 | A | * | 4/1901 | Steinfeld | 182/141 |
| 749,406 | A | * | 1/1904 | Spirq | 187/239 X |
| 856,576 | A | * | 6/1907 | Fullenlove | 187/352 |
| 947,075 | A | * | 1/1910 | Dodge | 187/343 |
| 1,071,655 | A | * | 8/1913 | Thompson | 187/343 X |
| 1,115,093 | A | * | 10/1914 | Nemth | 182/141 |
| 1,218,828 | A | * | 3/1917 | Barber et al. | 182/85 |
| 1,238,417 | A | * | 8/1917 | McClymonds | 187/352 X |
| 3,967,703 | A | * | 7/1976 | Martin | 187/352 X |
| 5,392,877 | A | * | 2/1995 | Shahin et al. | 182/82 |

FOREIGN PATENT DOCUMENTS

| | | | | | |
|---|---|---|---|---|---|
| GB | 2087351 | A | * | 5/1982 | 187/239 |

* cited by examiner

*Primary Examiner*—Eileen D. Lillis
*Assistant Examiner*—Thuy V. Tran
(74) *Attorney, Agent, or Firm*—Wenderoth, Lind & Ponack, L.L.P.

(57) ABSTRACT

An emergency escape veranda apparatus includes a movable veranda member (1) provided so as to form a veranda in a normal state together with a stationary veranda portion (2) projected outside a building. A lowering device (3) makes the movable veranda member (1) descend vertically in an emergency state.

8 Claims, 7 Drawing Sheets

EMERGENCY ESCAPE VERANDA APPARATUS

BACKGROUND OF THE INVENTTON

The present invention relates to an emergency escape veranda apparatus for enabling children, old persons, persons on wheelchairs and other persons who are in upstairs rooms to escape safely downstairs in an emergency by utilizing an outside veranda.

As conventional ways for enabling persons in upstairs rooms to flee downstairs in an emergency, an emergency exit hatch provided in the floor of an outside veranda and a folding ladder, and an escape ladder provided in advance on a wall for use in escaping an emergency have been generally used. When escaping downstairs by using the above-described conventional ways, the use of the ladders endangers the escape of children, old persons and other persons and makes the conventional ways substantively unusable for persons on wheelchairs and physically handicapped persons. The conventional ways have such disadvantages.

SUMMARY OF THE INVENTION

An object of the present invention is to provide an emergency escape veranda apparatus which has successfully solved the above-described disadvantages.

To this end, an emergency escape veranda apparatus according to the present invention includes a movable veranda member provided so as to form a veranda in a normal state together with a stationary veranda portion projected outside a building and lowering means for making the movable veranda member descend vertically in an emergency state.

Preferably, the lowering means is provided on an underside of the movable veranda member. Preferably, the lowering means includes a combination of a rack and a pinion. The rack extends vertically and the pinion is rotatably provided on the movable veranda member.

Preferably, the lowering means includes speed adjusting the descending speed of the movable veranda member in the emergency state.

Preferably, the emergency escape veranda apparatus further includes fixing means for fixing the movable veranda member at a predetermined vertical level in a normal state.

Preferably, the emergency escape veranda apparatus further includes an impact preventing brake which prevents an impact on the movable veranda member when the movable veranda member reaches the lowest vertical limit.

The present invention permits especially wheelchair users and other persons to use, in emergency, the outside veranda to flee safely downstairs by simple operation.

The emergency escape veranda apparatus preferably includes the speed adjusting device and the impact preventing brakes, whereby the apparatus can be used more safely.

DESCRIPTION OF THE PREFERRED EMBODIMENTS

The preferred embodiments of present invention will be described below with reference to the drawings.

Figure 1:
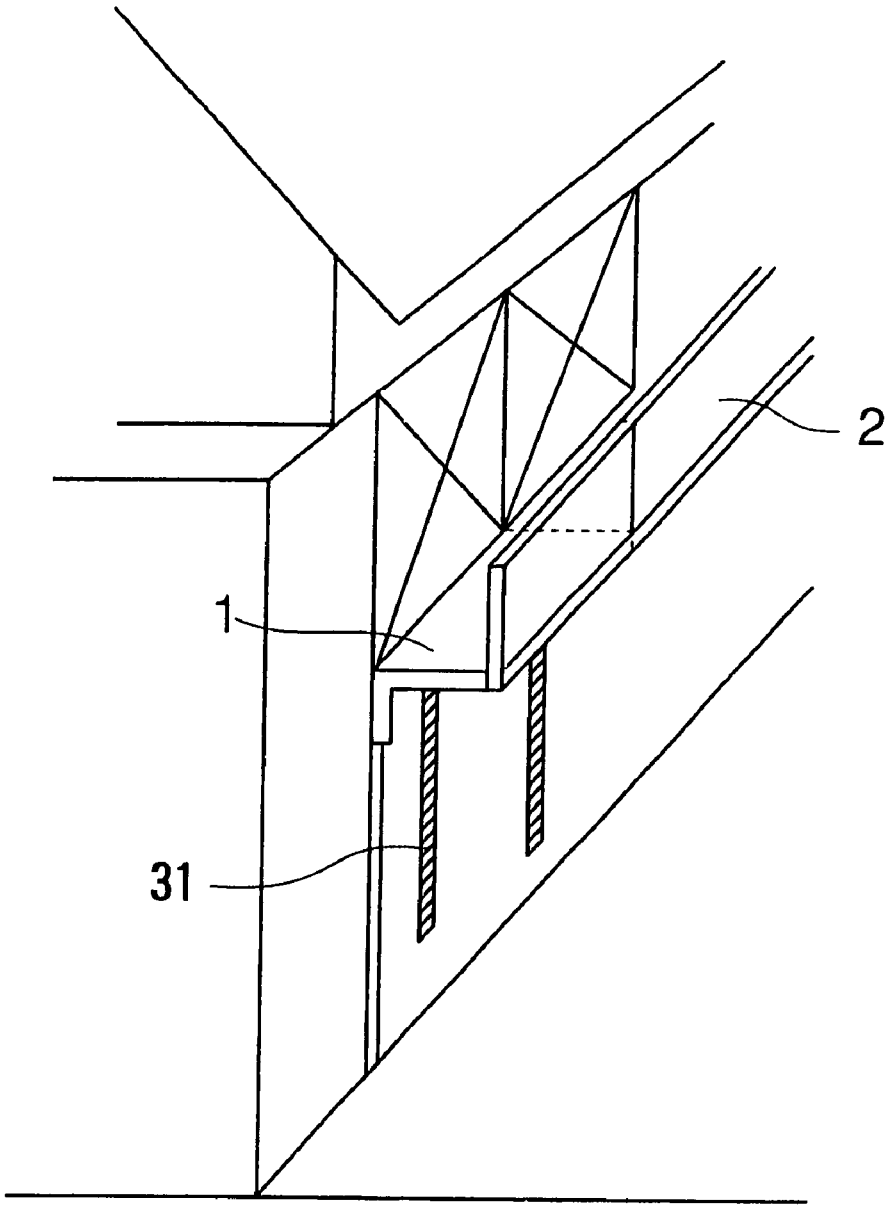
FIG. 1 is a perspective view of the emergency escape veranda apparatus according to the present invention.
Figure 2:
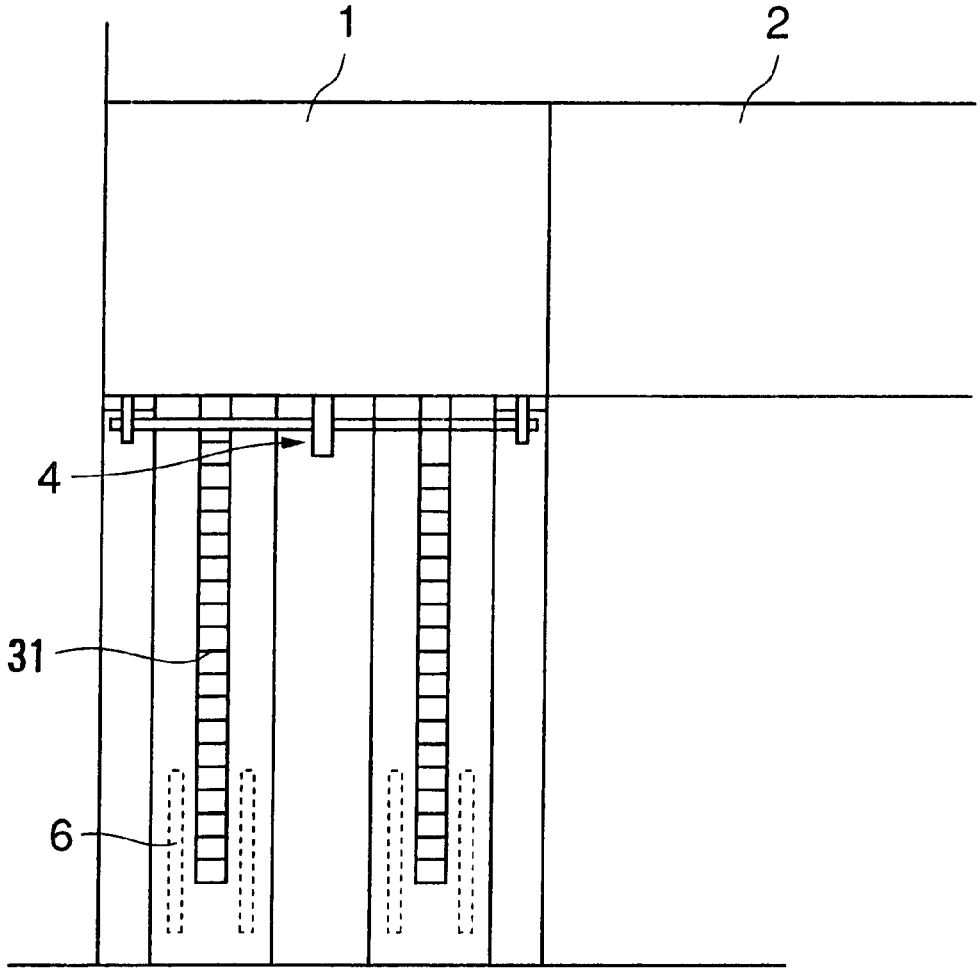
FIG. 2 is a front view of the emergency escape veranda apparatus according to the present invention.
Figure 3:
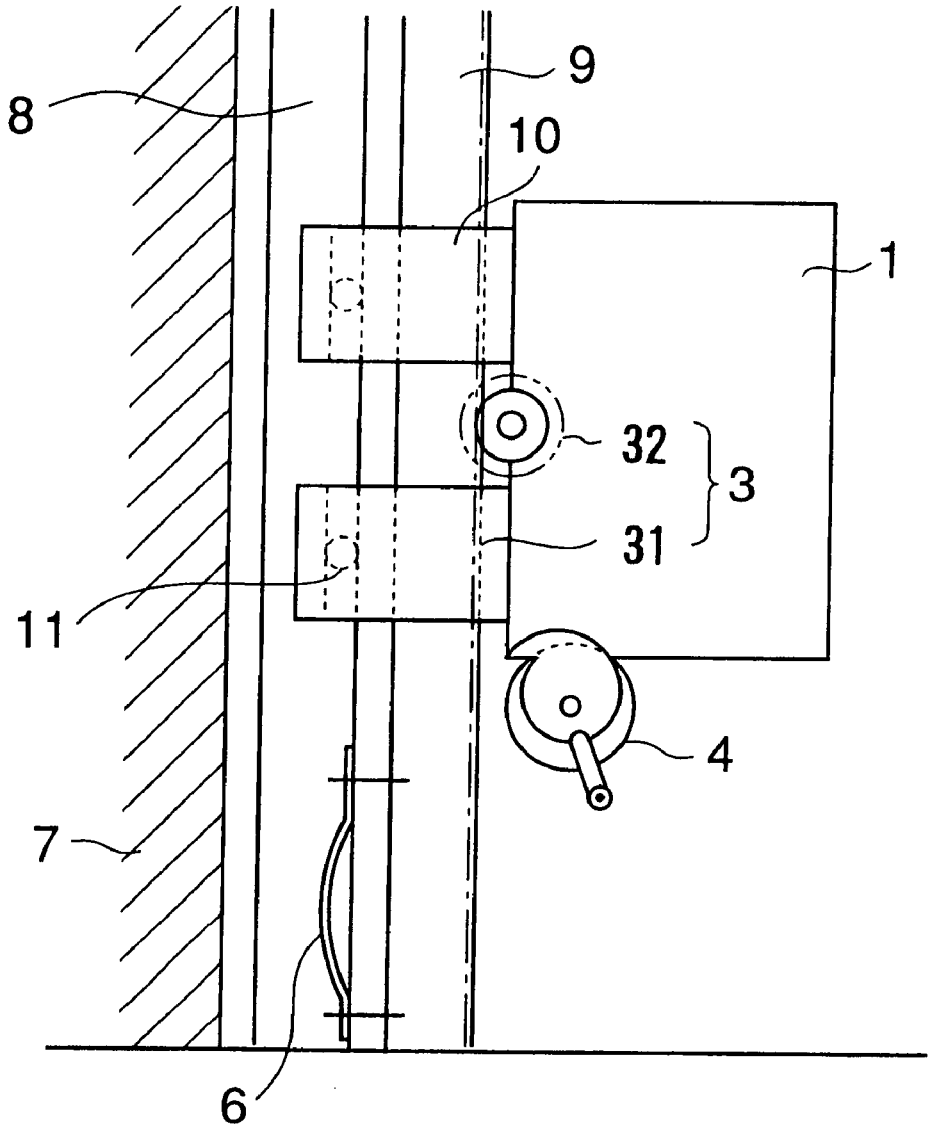
FIG. 3 is a side view of the emergency escape veranda apparatus according to the present invention.
Figure 4:
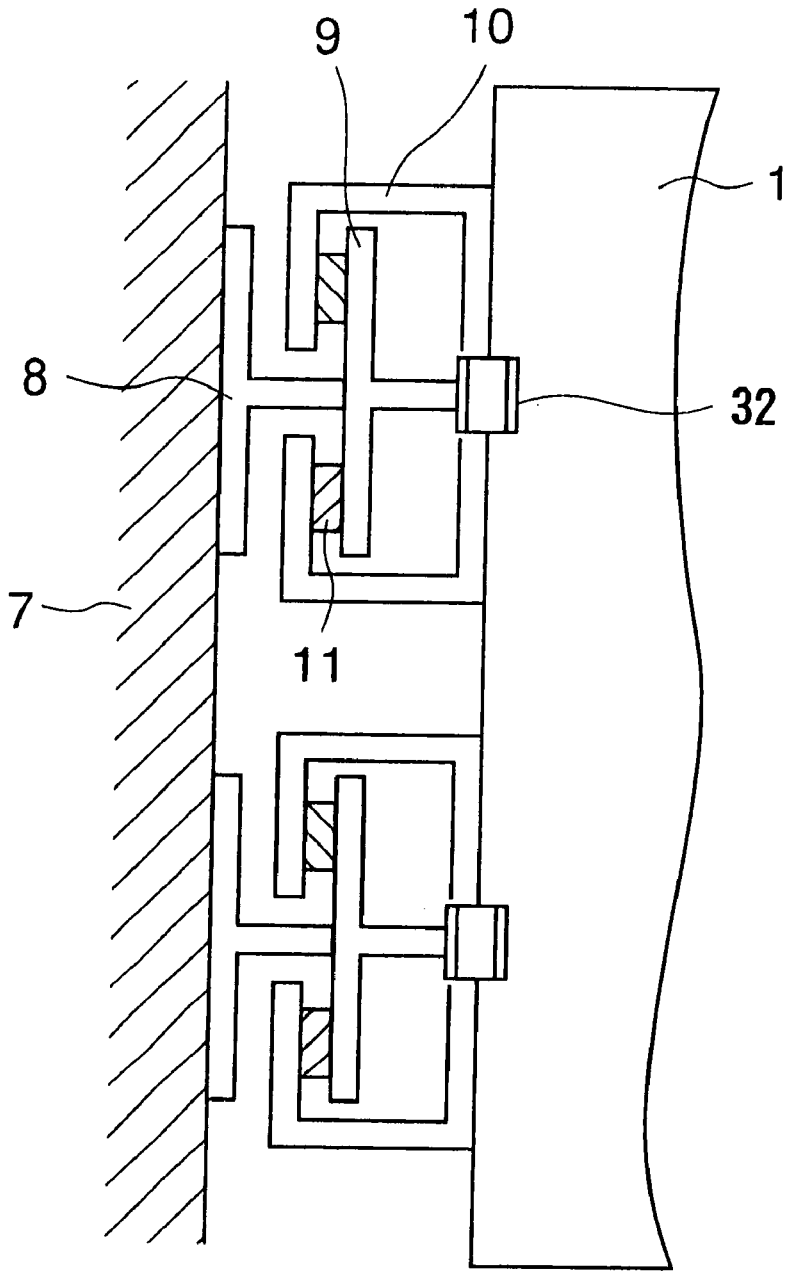
FIG. 4 is a plan view of the emergency escape veranda apparatus according to the present invention.
Figure 5:
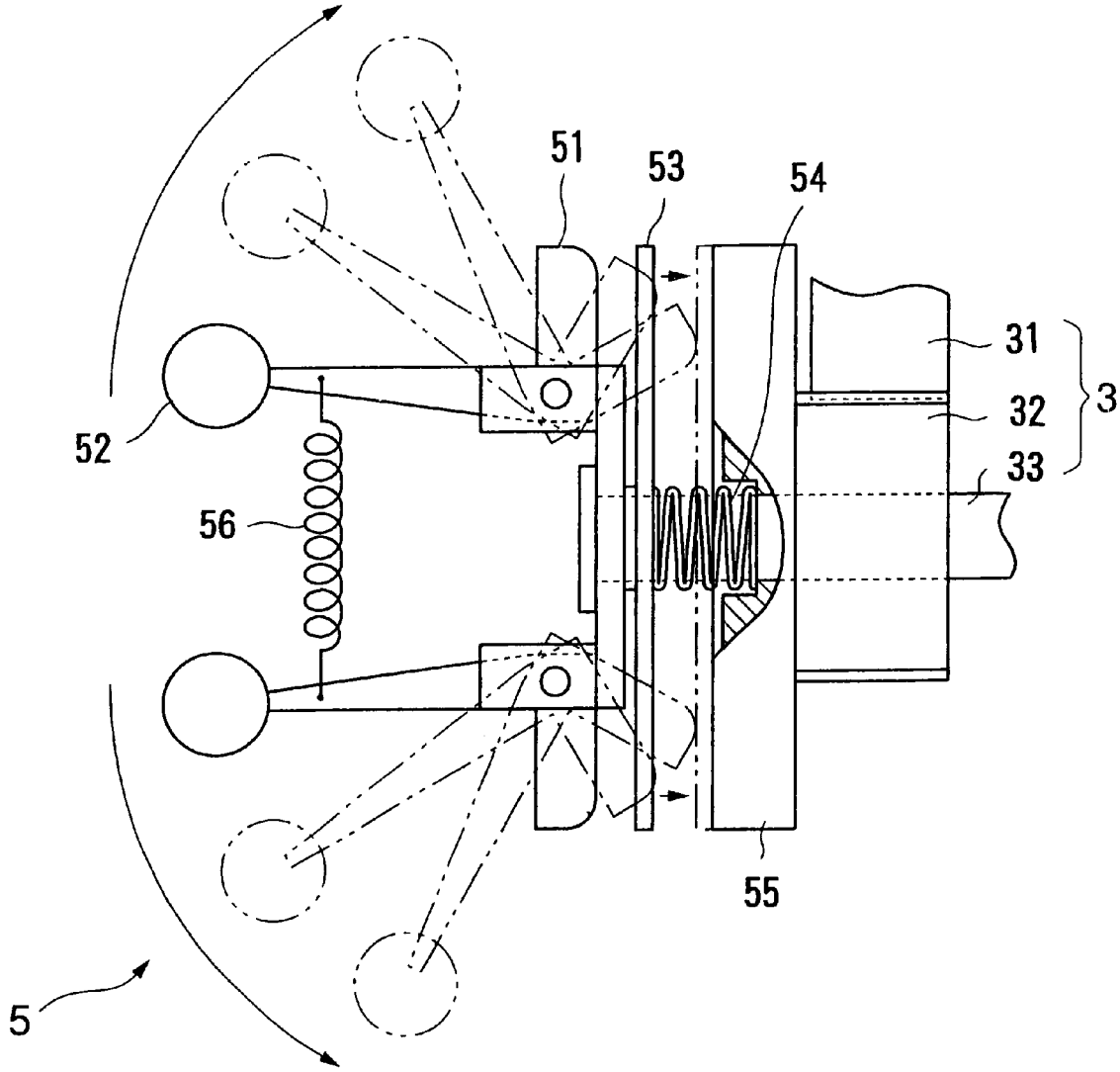
FIG. 5 is a plan view of the speed adjusting device used in the apparatus according to the present invention.
Figure 6:
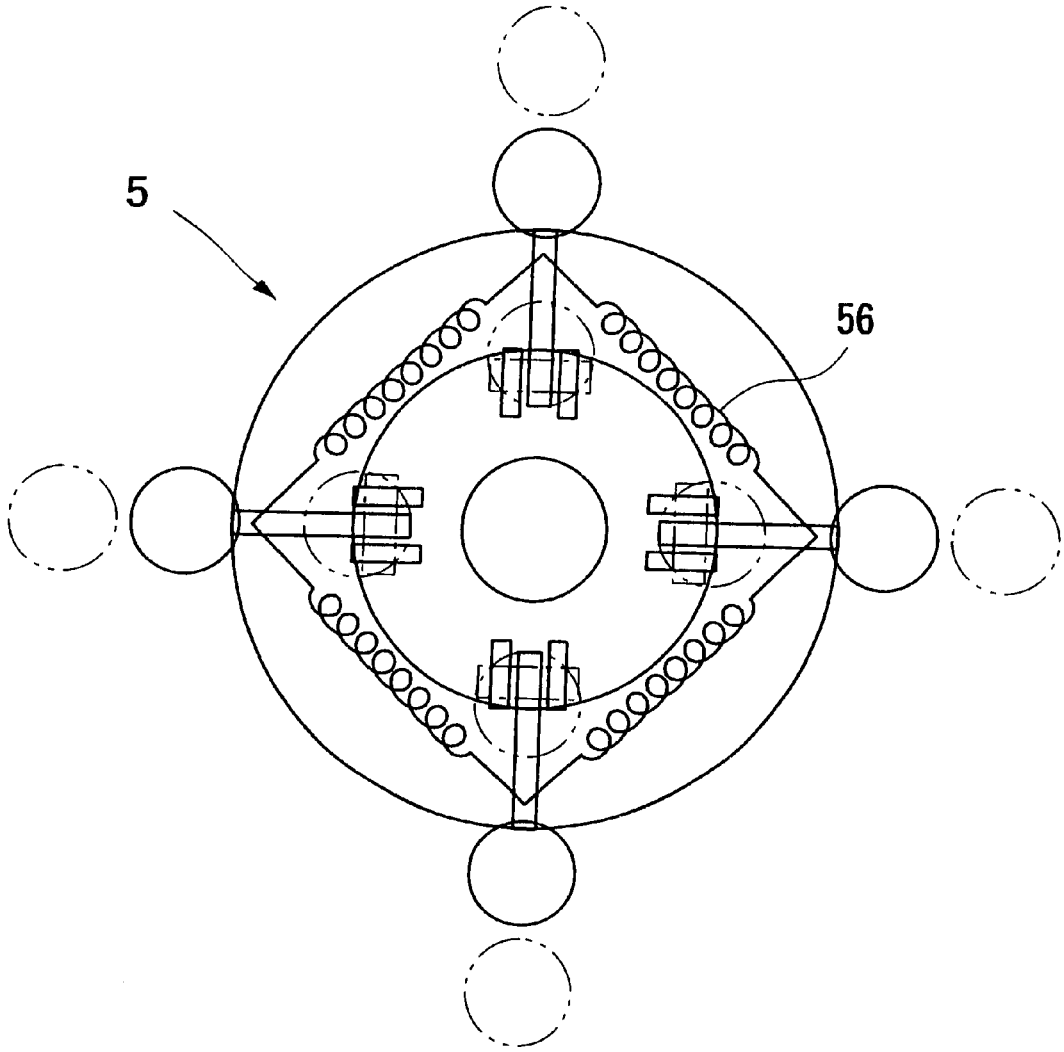
FIG. 6 is a left side view of the speed adjusting device shown in FIG. 5.
Figure 7:
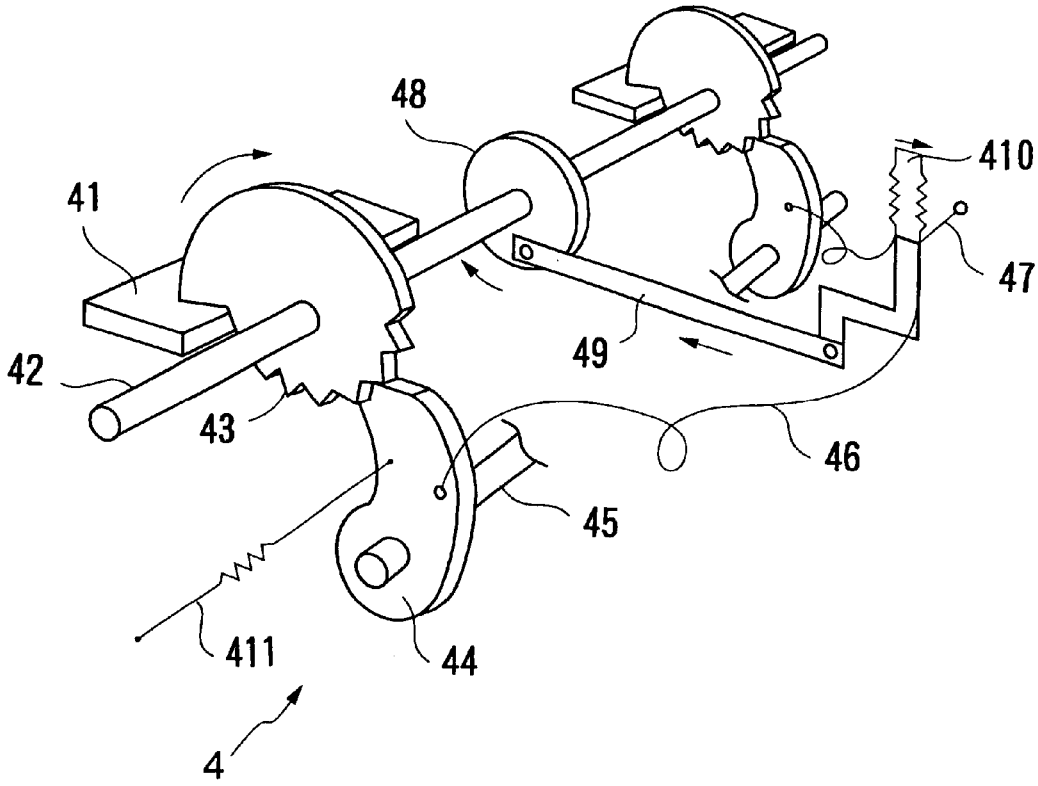
FIG. 7 is a perspective view of the fixing device.

FIG. 1 is a perspective view of the emergency escape veranda apparatus according to the present invention. FIG. 2 is a front view of the emergency escape veranda apparatus according to the present invention. FIG. 3 is a side view of the emergency escape veranda apparatus according to the present invention. FIG. 4 is a plan view of the emergency escape veranda apparatus according to the present invention. FIG. 5 is a plan view of a speed adjusting device used in the apparatus according to the present invention. FIG. 6 is a left side view of the speed adjusting device shown in FIG. 5. FIG. 7 is a perspective view of fixing device.

In FIG. 1, reference number 1 represents a movable veranda or balcony member. The movable veranda member 1 is separated from a stationary veranda 2 projected outside a building. The movable veranda member 1 can descend along racks 31 of lowering device. The racks 31 extend vertically below the movable veranda member 1.

In FIG. 2, reference number 4 represents the fixing device for fixing the movable veranda member 1 at a predetermined vertical level. Reference number 6 indicates an impact preventing brake, which will be detailed later.

The lowering device for the movable veranda member 1 will be explained with reference to FIGS. 3 and 4.

As shown in FIGS. 3 and 4, two T-steels 8 are vertically juxtaposed with each other at a prescribed pitch on an outside wall 7 of a building. Other T-steels 9 extend along the T-steels 8 and are connected to the respective T-steels 8 by means of welding or other ways.

On the other hand, lip channel steels 10 are mounted on the side surface of the movable veranda member 1 opposed to the outside wall 7 at the four upper left and right and lower left and right corners.

The T-steels 9 are positioned within the lip channel steels 10. One of the vertical side surfaces of each of the T-steels 9 functions as a rolling-slide surface for the rollers 11 rotatably mounted on inside surfaces of each of the lip channel steels 10 so as to guide the movable veranda member 1 for smooth descending.

As shown in FIGS. 2 and 3, impact-preventing brakes 6 in the form of leaf springs or otherwise are mounted vertically at a predetermined pitch on the vertical side surface of the T-steels 9 at several positions.

Reference number 3 in FIGS. 3 and 5 represents the lowering device. The lowering device 3 is constituted by pinions 32 rotatably mounted on one side surface of the movable veranda member 1, and the racks 31 formed in the other side surfaces of the respective T-steels 9.

The lowering device 3 has a speed adjusting device 5. One embodiment of the speed adjusting device 5 will be explained with reference to FIGS. 5 and 6.

That is, as shown in FIGS. 5 and 6, the lowering device 3 is constituted by the pinions 32 secured to shafts 33 mounted on the side surface of the movable veranda member 1, and the racks 31 formed in the T-steels 9. Four brake cams 51 constituting the speed adjusting device 5 are mounted on the end of each of the shafts 33. Spherical weights 52 are mounted on the tips of swingable arms connected to each brake cam 51.

When the movable veranda member 1 descends, the pinions 32 are rotated together with the shafts 33 in mesh with the racks 31, and the brake cams 51 interconnected with the shafts 33 start to be rotated. The weights 52 mounted on the tips of swingable arms connected to each brake cam 51 are also rotated and displaced by centrifugal force outward in the arrow direction. This displacement of the weights 52 displaces the brake cams 51 inward to press the left side surface, as viewed in the drawing, of a brake pad 53 having a hole in which the shaft 33 is inserted. The brake pad 53 is displaceable along the axial direction of the shaft 33. The brake pad 53 is displaced to the right as seen in the drawing against a compression spring 54 in which the shaft 33 is inserted.

Then, the brake pad 53, which has been displaced to the right, is brought into contact with one surface of a friction disc 55 having a hole in which the shaft 33 is inserted. The friction disc 55 is secured to the movable veranda member 1, etc., to thereby generate braking force by frictional contact.

This braking force decreases rotational speed of the shaft 33 to decrease a descending speed of the movable veranda member 1. When a descending speed of the movable veranda member 1 becomes a speed below a prescribed value, the brake pad 53 leaves the friction disc 55 to thereby increase the descending speed. The repetition of these actions adjusts the descending speed.

Reference number 56 represents springs which retain the respective weights 52 parallel with the axis of the shaft 33 when the movable veranda member 1 is stopped.

As described above, the speed adjusting device 5 adjusts a descending speed of the movable veranda member 1 by balancing a reaction force of the compression springs 54 and a contact friction force generated by a centrifugal force of the weights 52 and exerted to the friction discs 55.

One embodiment of the fixing device 4 for fixing the movable veranda member 1 will be explained with reference to FIG. 7.

The fixing device 4 is disposed on the underside of the movable veranda member 1. The fixing device 4 secures the movable veranda member 1 on the outside wall 7 of a building at a predetermined vertical level in the normal state.

Two stoppers 41 are fixed to the outside wall 7 below the underside of the movable veranda member 1. Two ratchets 43 are mounted on a shaft 42 mounted on the underside of the movable veranda member 1. The ratchets 43 are borne by the stoppers 41.

Two claws 44 are mounted on a shaft 45 which is also mounted on the underside of the movable veranda member 1. The claws 44 are meshed with the ratchets 43.

A wire 46 has one end connected to the claws 44 and has the other end connected to a lever 47. A restriction spring 411 is connected to the claws 44, so that the claws 44 are normally in mesh with the ratchets 43.

A crank disc 48 is mounted on the shaft 42 at the middle thereof. A link 49 has one end connected to the crank disc 48 and the other end connected to a handle 410.

The procedure of operating the emergency escape veranda apparatus according to the present invention will be explained.

In an emergency, a door partitioning a room and the veranda is opened to guide a person on a wheelchair and an attendant person onto the upper surface of the movable veranda member 1. Next, the lever 47 of the fixing device 4 is pulled, and the claws 44 are rotated against the restriction spring 411 through the wire 46 interconnected to the lever 47 to be released from the ratchets 43. In this state, the handle 410 is pulled, and this action is transmitted to the crank disc 48 via the link 49. The link 49 is rotated together with the shaft 42 while the ratchets 43 mounted on the shaft 42 are concurrently rotated, and the ratchets 43 are disengaged from the stoppers 41. When the ratchets 43 are disengaged from the stopper 41, the movable veranda member I starts to gradually descend by its own weight. The pinions 32 which are in mesh with the racks 31 of the lowering device 3 are rotated. The movable veranda member 1 keeps descending at a prescribed descending speed constantly adjusted by the speed adjusting device 5. Because the impact preventing brakes 6 are disposed on the vertical side surfaces of the T-steels 9, when the movable veranda member I passes the surfaces of the impact preventing brakes 6 while descending, the leaf springs exert forces to the rollers 11 to thereby mitigate impact and falling speed of the movable veranda member 1.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A veranda of a building comprising:

a building having a room and a door to said room in a wall of said building;

a veranda projecting from the outside of said building adjacent to said room such that said door partitions said room from said veranda, said veranda comprising:

a stationary veranda portion projecting on the outside of said building; and a movable veranda member configured so as to form said veranda in a normal state together with said stationary veranda portion such that said movable veranda member can be used together with said stationary veranda portion as said veranda in the normal state and configured so as to form an emergency escape apparatus in an emergency state that is usable from said room by persons that are handicapped or confined to a wheelchair, wherein said movable veranda member includes:

a fixing means for fixing said movable veranda member at a predetermined vertical level on said building adjacent to and level with said stationary veranda portion in the normal state, and a lowering means for controlling vertical lowering of said movable veranda member under its own weight in the emergency state;

wherein said lowering means includes speed adjusting means for adjusting a descending speed of said movable veranda member in the emergency state.

2. The apparatus of claim 1, and further comprising an impact preventing brake preventing an impact on said movable veranda member when said movable veranda member reaches a lowest vertical limit.

3. The veranda of claim 1, wherein said lowering means comprises a vertically extending rack and a pinion rotatably provided on said movable veranda member.

4. The veranda of claim 3, wherein said pinion is provided on an underside of said movable veranda member.

5. A balcony of a building comprising:

a building having a room and a door to said room in a wall of said building;

a balcony projecting from the outside of said building adjacent to said room such that said door partitions said room from said balcony, said balcony comprising:

a stationary balcony portion projecting on the outside of said building; and a movable balcony member configured so as to form said balcony in a normal state together with said stationary balcony portion such that said movable balcony member can be used together with said stationary balcony portion as a part of said balcony in the normal state and configured so as to form an emergency escape apparatus in an emergency state that is usable from said room by persons that are handicapped or confined to a wheelchair, wherein said movable balcony member includes:

a fixing device fixing said movable balcony member at a predetermined vertical level on said building adjacent to and level with said stationary balcony portion in the normal state, and a lowering device for controlling lowering said movable balcony member under its own weight in the emergency state, wherein said lowering device includes a speed adjusting device that controls descending speed of said movable balcony member in the emergency state.

6. The balcony of claim 5, and further comprising an impact preventing brake preventing an impact on said movable balcony member when said movable balcony member reaches a lowest vertical limit.

7. The balcony of claim 5, wherein said lowering device comprises a vertically extending rack and a pinion rotatably provided on said movable balcony member.

8. The balcony of claim 7, wherein said pinion is provided on an underside of said movable balcony member.

* * * * *